US006402552B1

(12) United States Patent
Wagner

(10) Patent No.: US 6,402,552 B1
(45) Date of Patent: Jun. 11, 2002

(54) ELECTRICAL CONNECTOR WITH OVERMOLDED AND SNAP LOCKED PIECES

(75) Inventor: Douglas L. Wagner, Newbury Park, CA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/923,938

(22) Filed: Aug. 7, 2001

(51) Int. Cl.[7] ..... H01R 13/58
(52) U.S. Cl. ..... 439/606; 439/736
(58) Field of Search ..... 439/604, 606, 439/636, 736, 701, 610

(56) References Cited

U.S. PATENT DOCUMENTS

| | | | | | |
|---|---|---|---|---|---|
| 4,457,576 | A | * | 7/1984 | Cosmos et al. | 439/610 |
| 4,838,808 | A | * | 6/1989 | Fujiura | 439/357 |
| 4,975,083 | A | | 12/1990 | Bird | 439/606 |
| 5,062,807 | A | * | 11/1991 | Guss, III | 439/490 |
| 5,364,292 | A | | 11/1994 | Bethurum | 439/610 |
| 5,462,457 | A | | 10/1995 | Schroepfer et al. | 439/736 |
| 5,518,421 | A | | 5/1996 | Davis | 439/607 |
| 5,597,324 | A | | 1/1997 | Katsunori | 439/587 |
| 5,603,638 | A | | 2/1997 | Brown et al. | 439/606 |
| 5,926,952 | A | | 7/1999 | Ito | 29/883 |
| 5,934,942 | A | | 8/1999 | Patel et al. | 439/610 |
| 5,964,622 | A | | 10/1999 | Ishikawa et al. | 439/606 |
| 6,004,160 | A | | 12/1999 | Korsunsky et al. | 439/660 |
| 6,129,589 | A | | 10/2000 | Simmel et al. | 439/660 |
| 6,190,212 | B1 | | 2/2001 | Brown et al. | 439/736 |
| 6,200,171 | B1 | | 3/2001 | Fusselman et al. | 439/736 |
| 6,206,731 | B1 | * | 3/2001 | Kuo | 439/610 |

* cited by examiner

*Primary Examiner*—Tulsidas Patel
(74) *Attorney, Agent, or Firm*—Harrington & Smith, LLP

(57) ABSTRACT

An electrical connector comprising a contact wafer having at least one electrical contact connected to a first housing piece; a second housing piece having a contact wafer receiving area with snap lock latching surfaces, and a third housing piece overmolded onto rear ends of the first and second housing pieces. The first housing piece is snap lock inserted into the contact wafer receiving area and forms a seal between the first and second housing pieces. The seal between the first and second housing pieces substantially prevents flash blow by between the first and second housing pieces of material that forms the third housing piece as the third housing piece is overmolded onto the first and second housing pieces.

22 Claims, 4 Drawing Sheets

ELECTRICAL CONNECTOR WITH OVERMOLDED AND SNAP LOCKED PIECES

BACKGROUND OF THE INVENTION

1. Field of the Invention

The present invention relates to electrical connectors and, more particularly, to an electrical connector with overmolded and snap locked pieces.

2. Brief Description of Prior Developments

U.S. Pat. No. 6,200,171 discloses an electrical connector with an overmolded housing member. Electrical contacts are inserted into a first housing member and then a second housing member is molded onto the first housing member and the electrical contacts. U.S. Pat. No. 5,926,952 discloses overmolding a housing piece on a pre-molded connector structure. Electrical connectors are also known as in the art, such as a ModJack™ electrical connector sold by FCI USA, Inc. of Etters, Pa. under the part number 66467-001, which comprises a first subassembly having a first housing member and electrical contacts which is fixedly inserted into a receiving area of a second housing member. There also exists in the art an electrical connector known as a Serial ATA connector which is generally used for disk drives and storage peripherals. The Serial ATA connector standard generally calls for a receptacle with a general L shaped receiving area and, electrical spring contacts on one side of a leg of the general L shaped receiving area.

Problems exists with manufacturing Serial ATA electrical connectors. There is a desire to manufacture Serial ATA connectors with the use of overmolding technology.

Overmolding of housing pieces can result in more precise manufacturing of electrical connector tolerances and, can reduce the cost of electrical connector manufacturing. However, the shape of a Serial ATA connector makes the use of overmolding technology difficult. In addition, a potential problem with the use of overmolding technology in an electrical connector receptacle is the problem of flash blow by into a receiving area intended to receive a mating electrical connector. Flash blow by could possibly block a portion of the receiving area thereby producing a defective electrical connector.

There is a desire to produce a receptacle electrical connector with the use of overmolding technology which is relatively easy to over mold an outer housing (forming a receptacle receiving area) onto a contact and housing subassembly to produce a substantially unitary structure. There is also a desire to produce a receptacle electrical connector with the use of overmolding technology having a reduced risk of flash blow by into a mating connector receiving area. There is also a desire to produce such receptacle electrical connectors as Serial ATA connectors.

SUMMARY OF THE INVENTION

In accordance with one embodiment of the present invention, an electrical connector is provided comprising a contact wafer having at least one electrical contact connected to a first housing piece; a second housing piece having a contact wafer receiving area with snap lock latching surfaces, and a third housing piece overmolded onto rear ends of the first and second housing pieces. The first housing piece is snap lock inserted into the contact wafer receiving area and forms a seal between the first and second housing pieces. The seal between the first and second housing pieces substantially prevents flash blow by between the first and second housing pieces of material that forms the third housing piece as the third housing piece is overmolded onto the first and second housing pieces.

In accordance with another embodiment of the present invention, an electrical connector is provided comprising a first outer housing member having a general L shaped connector receiving slot extending into a first end of the first outer housing member and a contact module receiving area at a rear end of the L shaped slot; a contact module located in the contact module receiving area, and a second outer housing member overmolded onto a rear end of the first outer housing member and onto a rear end of the contact module. The contact module comprises at least one electrical contact and a housing piece overmolded onto the contact. overmolding of the housing piece of the contact module on the contact forms a seal between the housing piece and the contact to prevent material of the second outer housing member from flowing through the contact module between the contact and the housing piece during overmolding of the second outer housing member.

In accordance with one method of the present invention, a method of manufacturing an electrical connector is provided comprising steps of overmolding a housing piece onto at least one electrical contact to form an electrical contact module, the housing piece forming a seal around the contact; snap lock mounting the electrical contact module into a receiving area in a first outer housing member; and overmolding a second outer housing member onto the first outer housing member and the electrical contact module. The seal between the contact and the housing piece of the contact module, formed by overmolding the housing piece onto the contact, prevents material of the second outer housing member from passing between the housing piece and the contact during overmolding of the second outer housing member onto the first outer housing member and the electrical contact module.

In accordance with another method of the present invention, a method of manufacturing an electrical connector is provided comprising steps of overmolding a housing piece onto at least one electrical contact to form an electrical contact module, the at least one electrical contact having a tail extending out of the housing piece in a general straight direction; connecting the electrical contact module with first housing member; overmolding a second outer housing member onto the first outer housing member and onto the electrical contact module at the tail; and optionally bending the tail. When the tail is not bent, the second outer housing member is overmolded to extend in a general reward direction from the first outer housing member to form the connector as a general straight connector. When the tail is bent, the second outer housing member is overmolded to extend in a general lateral direction from the first outer housing member to form the connector as a right angle connector.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
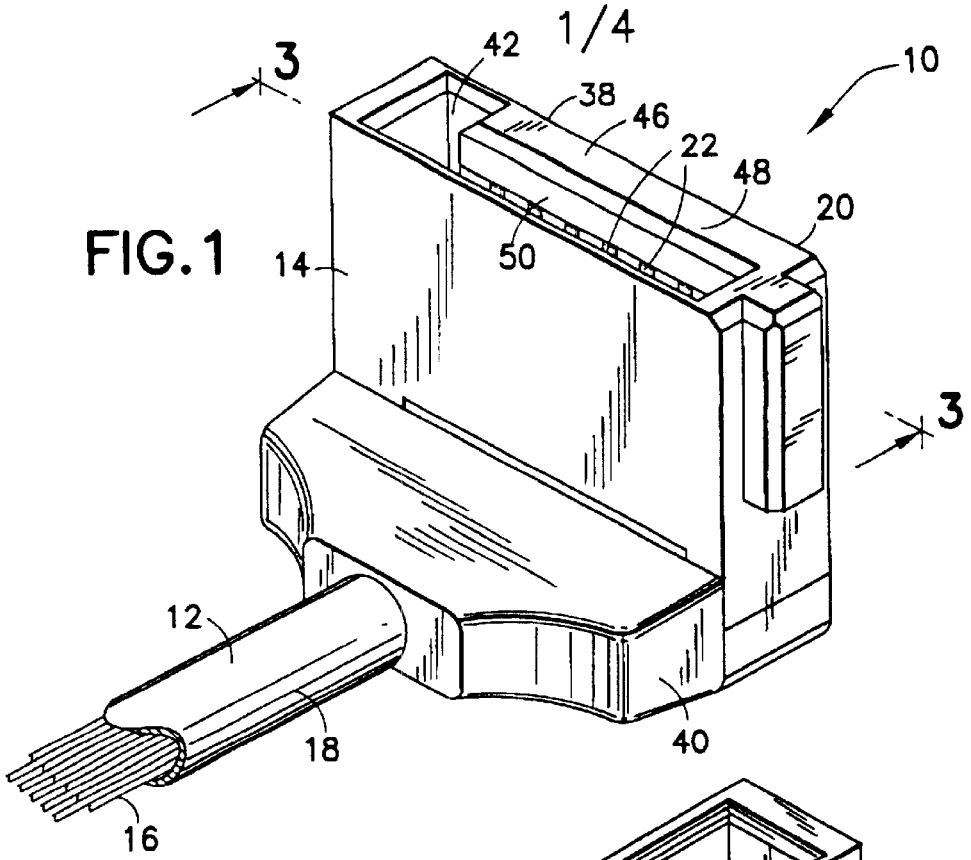
FIG. 1 is a perspective view of an end of an electrical connector and cable assembly incorporating features of the present invention.

Referring to FIG. 1, there is shown a perspective view of an end of an electrical connector and cable assembly 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

The assembly 10 generally comprises an electrical conductor cable 12 and an electrical connector 14. The cable 12 is a conventional electrical conductor cable comprising a plurality of electrical wires or conductors 16 surrounded by an outer insulating cover 18. However, features of the present invention could be used with any suitable type of electrical cable or electrical conductor.

Figure 2:
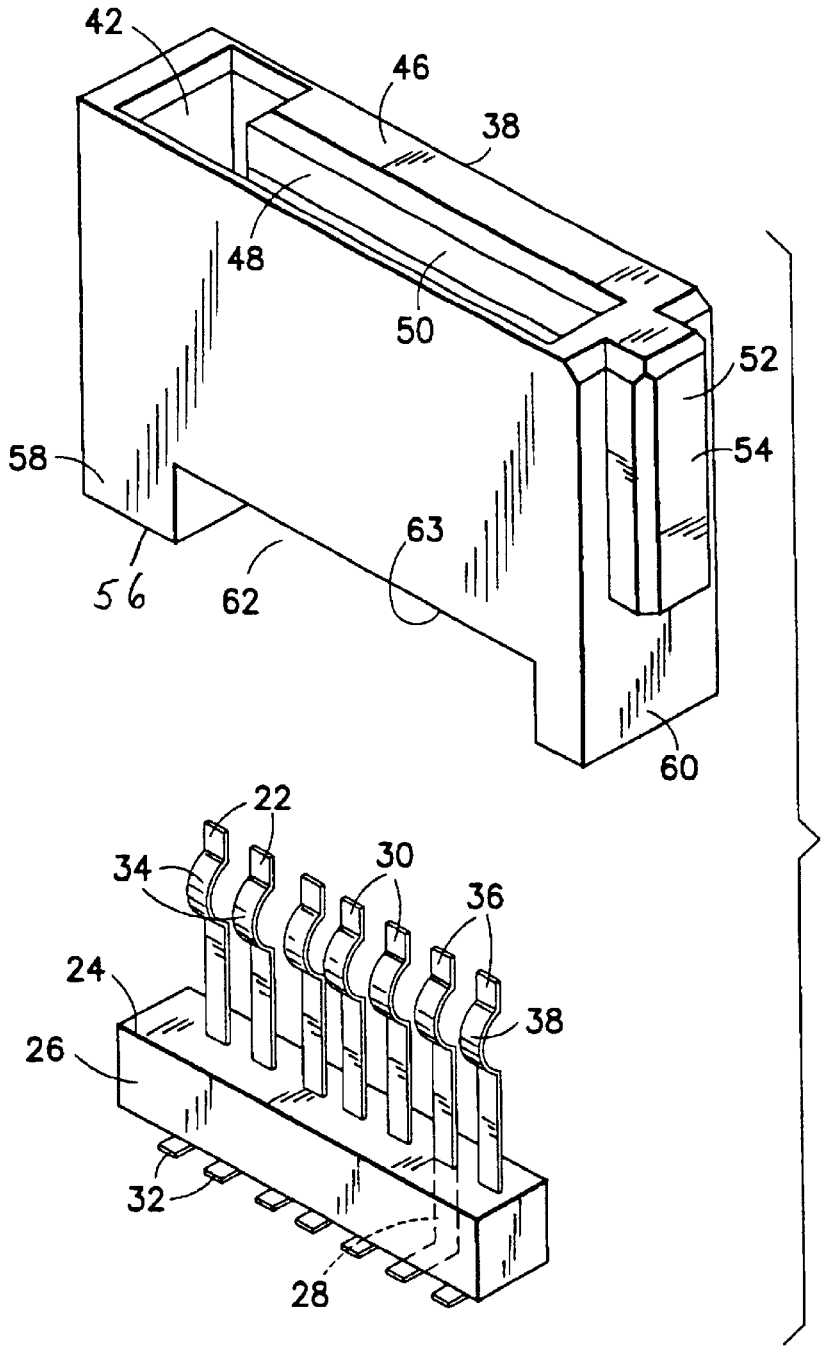
FIG. 2 is an exploded perspective view of portions of the electrical connector shown in FIG. 1.
Figure 3:
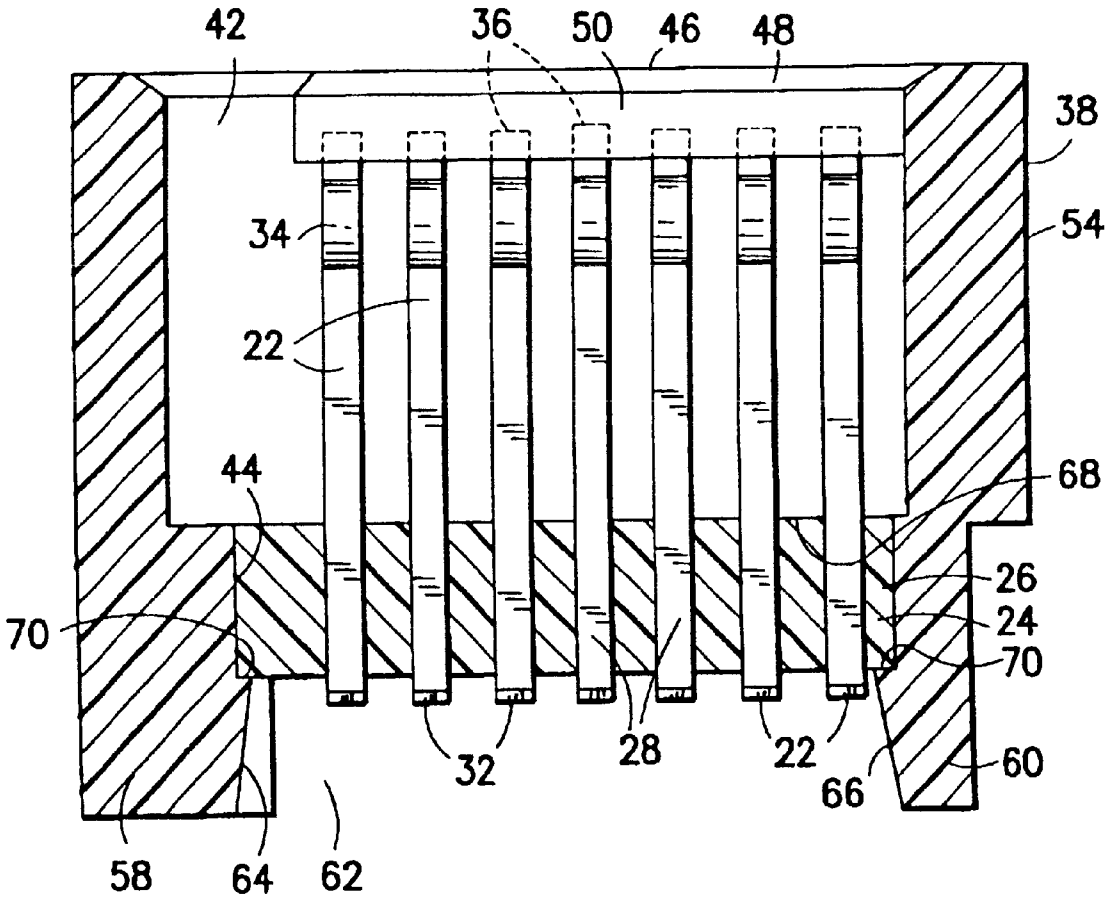
FIG. 3 is a cross sectional view of the portions of the electrical connector shown in FIG. 2.

Referring also to FIGS. 2–3, the electrical connector 14 generally comprises a housing 20 and electrical contacts 22. However, in alternate embodiments, the electrical connector could comprise additional components. In the embodiment shown, the electrical contacts 22 are provided as part of a contact wafer assembly or electrical contact module 24. The contact wafer assembly 24 generally comprises the electrical contacts 22 and a first housing piece 26. The electrical contacts 22 generally each comprise a mounting section 28, a top section 30, and a bottom section or tail 32. In the embodiment shown, each contact 22 is formed from a flat metal member which is formed, such as by stamping, into the shapes shown. However, in alternate embodiments, any suitable type of stock member could be used to form the contacts, and the contacts can have any suitable type of shape.

The mounting section 28 is located in the first housing piece 26. The first housing piece 26 is preferably comprised of a one-piece member made of molded plastic or polymer material. However, in alternate embodiments, the first housing piece of could be comprised of multiple members and could comprise any suitable type of materials. In a preferred method of manufacturing the contact wafer assembly 24, the first housing piece 26 is overmolded onto the contacts 22. However, in an alternate embodiment, the first housing piece could be manufactured separately from the contacts and later assembled with the contacts. In the embodiment shown, overmolding the first housing piece 26 onto the contacts 22 fixedly attaches the contacts to the first housing piece. However, any suitable means could be used to attach the contacts to the first housing piece. The first housing piece 26 has a general rectangular block shape. However, in alternate embodiments, the first housing piece could have any suitable type of shape.

In the embodiment shown, the contact wafer assembly 24 comprises seven of the contacts 22. However, in alternate embodiments, more or less than the seven contacts could be provided. In addition, different types of contacts could additionally be provided. The contacts 22 are preferably arranged under the serial ATA electrical connector standard. However, the contacts could be arranged in any suitable configuration. The contacts 22 are aligned in a single row along the elongated length of the first housing piece 26. However, in alternate embodiments, the contacts 22 could be arranged in multiple rows, or could be arranged in any suitable type of array. In the embodiment shown, the connector 14 comprises only one contact wafer assembly. However, in alternate embodiments, more than one contact wafer assembly could be provided.

The top section 30 of each contact 22 extends from the top of the first housing piece 26 in a general cantilever fashion. The top sections 30 form general spring contact sections. Each top section 30 comprises a projection 34 and a top end 36. The projection 34, in the embodiment shown, comprises a bend. However, any suitable type of projection could be provided. The outer end 38 of the projections 34 forms a contact area for making electrical contact with contacts of a mating electrical connector (not shown). Each ledged 26 is adapted to mount behind a preload ledge of the housing as further described below. In an alternate embodiment, any suitable type of top section could be provided for the contacts.

The bottom section 32 of each contact forms a tail for attachment to one of the electrical conductors 16 in the cable 12 as a wire termination section. The conductors 16 can be fixedly attached to the contacts 22 at the tails 32, such as by soldering or welding. The tails 32 could be flat as shown, or could be contoured to form a channel for receiving a conductor of the wires 16 therein, such as a U shape or a spoon shape, to locate the wire prior to soldering or welding. Each tail 32 extends from a bottom side of the first housing member 26. The tails 32 are bent along the bottom side of the first housing member at a general right angle. Thus, the tails 32 extend at a general right angle from the first housing member has seen best in FIG. 2. In an alternate embodiment, any suitable type or shape of tail could be provided for the contacts. The wires 16 could be connected to the wafer assembly 24 and then loaded into the second housing piece 38 or, loaded into the second housing piece 38 and then attached to the wafer assembly.

The housing 20 generally comprises the first housing piece 26, a second housing piece 38, and a third housing piece 40. The second housing piece 38 and the third housing piece 40 form an outer housing of the connector 14. However, in alternate embodiments, the outer housing could be formed by more than two pieces. The second housing piece 38 forms a first outer housing member. The second housing piece 38 is preferably comprised of a one-piece molded plastic or polymer member. However, in alternate embodiments, the second housing piece could be comprised of multiple members and, could be comprised of any suitable materials.

The second housing piece 38 generally comprises a mating connector receiving slot 42 and a contact wafer receiving area 44. The mating connector receiving slot 42 has a general L shape. The slot 42 extends into a front end 46 of the second housing piece 38. The slot 42 extends from the front end 46 to the contact wafer receiving area 44. The general L shape of the connector receiving slot 42 is provided to provide polarization for a mating electrical connector (not shown), and for locating the inserted mating connector at a relatively precise position relative to the contacts 22. The mating electrical connector is inserted into the slot 42 through the front end 46 of the connector. The second housing piece is specifically designed for use under the serial ATA electrical connector standard. However, the connector 14 could be provided as other than a serial ATA electrical connector.

The front end 46 of the second housing piece 38 has a section 48. The section 48 extends along the top of the connector receiving slot 42 along one side of an elongated section of the general L shape. The section 48 has an inward projection 50. The inward projection 50 extends generally towards the contact wafer receiving area 44. However, in alternate embodiments, the section 48 might not be provided, or the section 48 could have any suitable type of shape. The inward projection 50 forms a preload shelf or section for the top ends 36 of the contacts 22. A lateral side 52 of the second housing piece 38 comprises a keying projection 54. The keying projection 54 can be used to polarize insertion of the connector 14 into a receiving slot of a housing of an electronic component (not shown). However, in an alternate embodiment, the keying projection might not be provided. Alternatively, any suitable type of keying system could be provided.

The rear end 56 of the second housing piece 38 generally comprises two lateral end sections 58, 60 with an open space 62 therebetween. The open space 62 forms a lateral slot 63 at the rear end of the first outer housing member 38. The open space 62 forms an entrance or hole into the bottom of the contact wafer receiving area 44. The two end sections 58, 60 have inward facing walls 64, 66 which taper inwardly as they approach the contact wafer receiving area 44 to form ramps. However, in alternate embodiments, the rear end of the second housing piece could have any suitable type of shape.

The contact wafer receiving area 44 is generally the same size and shape as the first housing piece 26. A top end of the contact wafer receiving area 44 is bounded by ledges 68 at the boundary between the receiving area 44 and the slot 42. The ledges 68 are located on opposite sides of the slot 42. The ledges 68 function as stops to stop the insertion of the first housing piece 26 at a predetermined location relative to the second housing piece 38. Located opposite the ledges 68, the two end sections 58, 60 comprise snap lock latches 70.

The first housing piece 26 can be inserted into the contact wafer receiving area 44 by insertion through the entrance 62 at the rear end of the second housing piece 38. The tapered inward facing walls 64, 66 guide the first housing piece 26 into the receiving area 44. The end sections 58, 60 resiliently deflect outward until the first housing piece 26 passes the snap lock latches 70. The end sections 58, 60 then snap behind the bottom end of the first housing piece 26 to snap lock mount the first housing piece 26 in the contact wafer receiving area 44. This fixedly and substantially stationarily connects the first housing piece 26 to the second housing piece 38. Contact between the first housing piece 26 and the second housing piece 38 in the receiving area 44 forms a seal between the open space 62 and the connector receiving slot 42. More specifically, the ledges 68 contact the top side of the first housing piece 26, the snap lock latches 70 contact the bottom side of the first housing piece 26, and the four lateral sides of the first housing piece 26 contact the four lateral sides of the second housing piece 38 in the contact receiving area 44.

When the first housing piece 26 of the contact wafer assembly 24 is inserted into the contact wafer receiving area 44, the top sections 30 of the contacts 22 extend into the mating connector receiving slot 42. The top ends 36 of the contacts 22 project into an area behind the preload projection 50. More specifically, the top ends 36 or preloaded or biased against the projection 50. The tails 32 of the contacts 22 are located in the open space 62 at the rear end of the second housing piece 38. The tails 32 of the contacts extend into the lateral slot 63. The open space 62 also allows for inspection of the solder joint and testing of the connection and contact prior to overmolding the third housing piece 40. The contacts 22 and the mating connector receiving slot 42 have a serial ATA electrical connector configuration for receiving a serial ATA L shaped blade-on-beam male connector.

The third housing piece 40 forms a second outer housing member as part of the outer housing for the electrical connector 14. In this embodiment, the third housing piece 40 forms a strain relief between the second housing member 38 and the cable 12. The third housing piece 40 also functions as a cover to cover electrical connections between the conductors 16 and the contacts 22 at the tails 32 of the contacts. The third housing piece 40 is preferably comprised of molded plastic or polymer material. The third housing piece 40 is preferably overmolded onto rear ends of the first and second housing pieces. The seal between the first and second housing pieces 26, 38 at the contact wafer receiving area 44 substantially prevents flash blow by between the first and second housing pieces of the material that forms the third housing piece as the third housing piece is overmolded onto the first and second housing pieces. Because the first housing piece 26 is overmolded onto the contacts 22, seals are also formed between the contacts and the first housing piece at the mounting sections 28. These seals prevent material of the third housing piece from directly passing between the first housing piece 26 and the contacts 22 during overmolding of the third housing piece 40. The third housing piece 40 is also overmolded directly onto ends of the conductors 16 and the tails 32 of the contacts to insulate the connection therebetween.

In the embodiment shown, the third housing piece 40 extends in a general lateral direction from the second housing piece 38. Thus, the connector 14 is formed as a right angle connector. However, in alternate embodiments, the third housing piece 40 could extend in any suitable direction.

Figure 4:
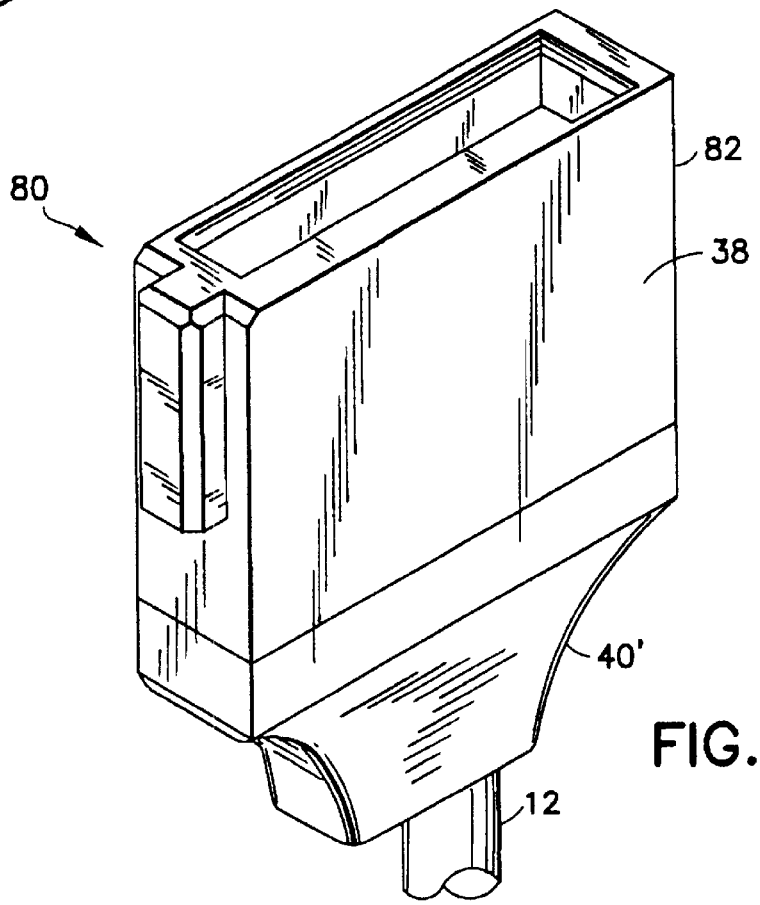
FIG. 4 is a perspective view of an alternate embodiment of the electrical connector shown in FIG. 1.
Figure 5:
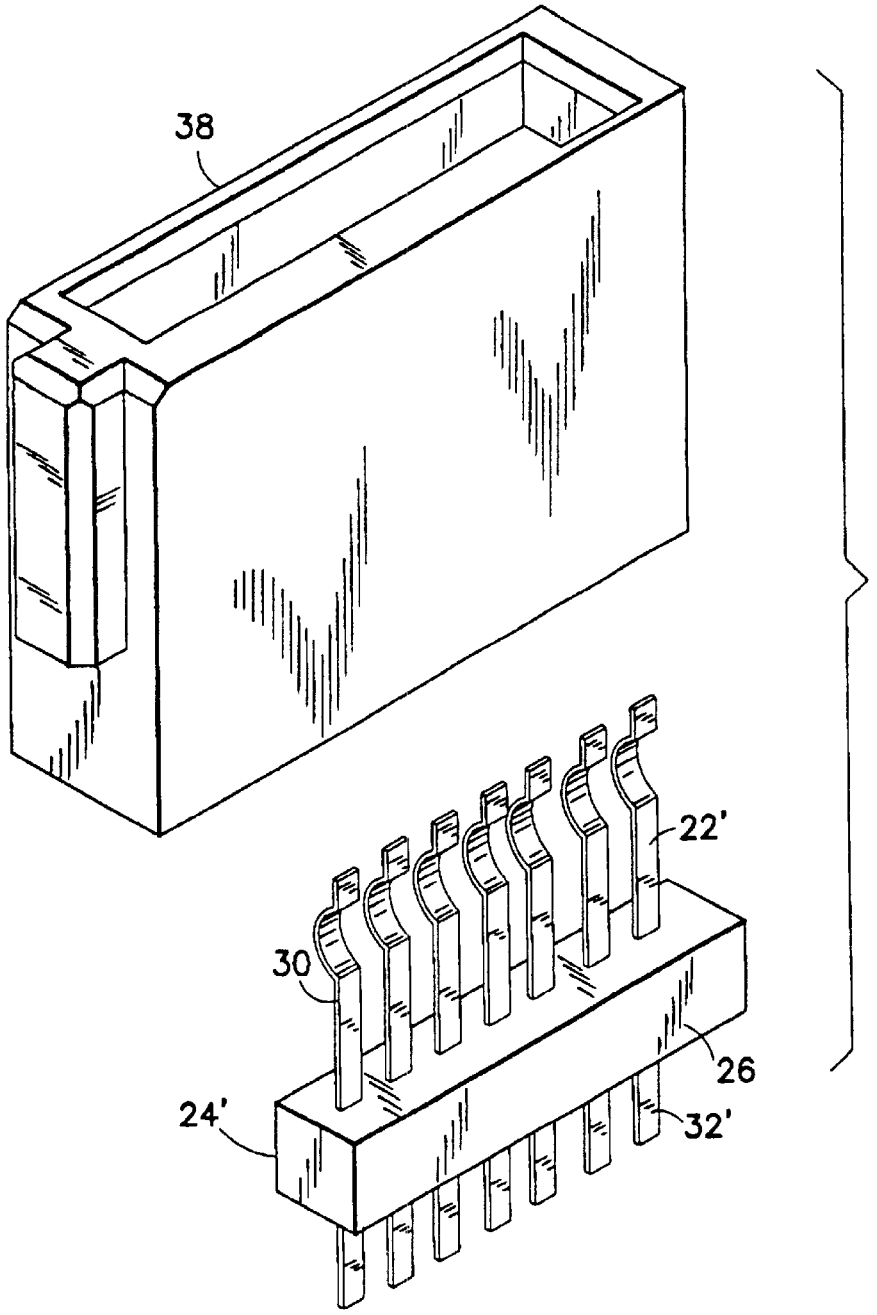
FIG. 5 is an exploded perspective view of portions of the alternate embodiment shown in FIG. 4.

Referring now to FIGS. 4 and 5, an alternate embodiment of the present invention will be described. The electrical connector 80 is substantially similar to the electrical connector 14. The connector 80 generally comprises a housing 82 and electrical contacts 22'. The contacts 22' are provided as part of a contact wafer assembly 24'. The contact wafer assembly 24' comprises a first housing piece 26 and the electrical contacts 22'. The housing 82 generally comprises the first housing piece 26, the second housing piece 38, and a third housing piece 40'. The third housing piece 40' extends directly reward from the rear end of the second housing piece 38. Thus, unlike the right angle connector shown in FIG. 1, the connector 80 forms a substantially straight connector.

The contacts 22' are substantially identical to the contacts 22 shown in FIG. 2. However, the contacts 22' have different bottom sections or tails 32'. More specifically, the tails 32' are substantially straight. This differs from the bent tails 32 shown in FIG. 2. The top sections 30 of the two contact wafer assemblies are the same. In order to form the contact wafer assembly 24 shown in FIG. 2, the contact wafer assembly 24' shown in FIG. 5 is manufactured and then the tails 32' are bent to form the tails 32. Thus, the same contact wafer assembly 24' can be used for either a right angle connector or a straight connector by merely bending or not bending the tails 32'. The same second housing piece 38 is also used for either the right angle connector or the straight connector.

One type of method for manufacturing the connectors 14, 80 can comprise the following steps:

- overmolding the housing piece 26 onto at least one electrical contact 22' to form an electrical contact module 24', the contact having a tail 32' extending out of the housing piece 26 in a general straight direction;
- optionally bending the tail 32' to form the tail 32,
- connecting the electrical contact module (24 or 24') with first outer housing member 38; and overmolding the second outer housing member (40 or 40') onto the first outer housing member 38 and onto the electrical contact module (24 or 24') at the tail (32 or 32');

wherein when the tail is not bent (i.e., tail 32') the second outer housing member is overmolded to extend in a general reward direction from the first outer housing member (i.e., member 40' is formed) to form the connector as a substantially straight connector and, when the tail is bent (i.e., tail 32) the second outer housing member is overmolded to extend in a general lateral direction from the first outer housing member (i.e., member 40 is formed) to form the connector as a substantially right angle connector.

In alternate embodiments, additional or alternative steps could be provided. Any suitable type of method for manufacturing the connectors as described above could also be provided. For example, in an alternate embodiment, the strain relief member could be snapped onto the first outer housing member 38. The process could be upgraded to an automated system by having a contact wafer feed track. The present invention can allow a step assembly process of the connectors. overmolding of the strain relief member is easier, and there is less risk that material of the strain relief member will blow by the housing pieces 26, 38 during overmolding.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

a contact wafer comprising at least one electrical contact Connected to a first housing piece;

a second housing piece having a contact wafer receiving area with snap lock latching surfaces, the first housing piece being snap lock inserted into the contact wafer receiving area and forming a seal between the first and second housing pieces; and a third housing piece overmolded onto rear ends of the first and second housing pieces, wherein the seal between the first and second housing pieces substantially prevents flash flow of material, which forms the third housing piece, between the first and second housing pieces as the third housing piece is overmolded onto the first and second housing pieces.

2. An electrical connector as in claim 1 wherein the first housing piece comprises a polymer material which is overmolded onto the at least one electrical contact.

3. An electrical connector as in claim 2 wherein the contact wafer comprises a plurality of the contacts aligned in a row.

4. An electrical connector as in claim 3 wherein the first housing piece has a general rectangular block shape with opposite ends of the contacts extending from respective top and bottom sides of the general rectangular block shape.

5. An electrical connector as in claim 4 wherein top ends of the contacts form spring contact sections.

6. An electrical connector as in claim 5 wherein bottom ends of the contacts form wire termination sections for fixedly attaching electrical conductors to the wire termination sections.

7. An electrical connector as in claim 5 wherein the second housing piece comprises a preload section, and wherein the top ends of the contacts are biased against the preload section.

8. An electrical connector as in claim 1 wherein the second housing piece has a front end with a connector receiving slot extending towards the contact wafer receiving area, and wherein the connector receiving slot has a general L shaped cross section.

9. An electrical connector as in claim 1 wherein the third housing piece extends in a rearward direction from the second housing piece.

10. An electrical connector as in claim 1 wherein the third housing piece extends in a general lateral direction from the second housing piece.

11. An electrical connector comprising:

a first outer housing member having a general L shaped connector receiving slot extending into a first end of the first outer housing member and a contact module receiving area at a rear end of the L shaped slot;

a contact module located in the contact module receiving area, the contact module comprising at least one electrical contact and a housing piece overmolded onto the contact; and a second outer housing member overmolded onto a rear end of the first outer housing member and onto a rear end of the contact module, wherein overmolding of the housing piece of the contact module on the contact forms a seal between the housing piece and the contact to prevent material of the second outer housing member from flowing through the contact module between the contact and the housing piece during overmolding of the second outer housing member.

12. An electrical connector as in claim 11 wherein the first outer housing member comprises a preload section extending into the contact receiving slot from the first end, and wherein the contact has a front end biased against the preload section.

13. An electrical connector as in claim 11 wherein the contact module comprises a plurality of the electrical contacts aligned in a row, and wherein the housing piece has a general rectangular block shape.

14. An electrical connector as in claim 11 wherein the first outer housing member comprises snap lock latches in the contact module receiving area, and wherein the housing piece of the contact module is snap lock connected with the snap lock latches.

15. An electrical connector as in claim 11 wherein the first outer housing member has a lateral slot at the rear end of the first outer housing member, and wherein a rear tail of the at least one electrical contact can be bent to extend into the lateral slot, and the second outer housing member can be overmolded onto the first outer housing member to extend laterally from the first outer housing member to form a right angle connector.

16. A method of manufacturing an electrical connector comprising steps of:

overmolding a housing piece onto at least one electrical contact to form an electrical contact module, the housing piece forming a seal around the contact;

snap lock mounting the electrical contact module into a receiving area in a first outer housing member; and overmolding a second outer housing member onto the first outer housing member and the electrical contact module, wherein the seal between the contact and the housing piece of the contact module, formed by overmolding the housing piece onto the contact, prevents material of the second outer housing member from passing between the housing piece and the contact during overmolding of the second outer housing member onto the first outer housing member and the electrical contact module.

17. A method as in claim 16 wherein the step of overmolding the housing piece onto the electrical contact comprises overmolding the housing piece onto a plurality of the electrical contacts, and wherein the housing piece has a general rectangular block shape.

18. A method as in claim 16 further comprising bending a tail end of the contact at a bottom end of the housing piece, and wherein the step of overmolding a second outer housing member onto the first outer housing member comprises the second outer housing member extending from the first outer housing member in a general lateral direction.

19. A method as in claim 16 wherein the step of snap lock mounting the electrical contact module into the receiving area comprises inserting the electrical contact module through a hole in a rear end of the first outer housing member.

20. A method of manufacturing an electrical connector comprising steps of:

overmolding a housing piece onto at least one electrical contact to form an electrical contact module, the at least one electrical contact having a tail extending out of the housing piece in a general straight direction;

connecting the electrical contact module with first housing member;

overmolding a second outer housing member onto the first outer housing member and onto the electrical contact module at the tail; and optionally bending the tail, wherein when the tail is not bent the second outer housing member is overmolded to extend in a general reward direction from the first outer housing member to form the connector as a substantially straight connector, and wherein when the tail is bent the second outer housing member is overmolded to extend in a general lateral direction from the first outer housing member to form the connector as a substantially right angle connector.

21. A method as in claim 20 wherein the step of connecting the electrical contact module with the first outer housing member comprises inserting the electrical contact module into a hole at a rear end of the first outer housing member and snap lock connecting the housing piece of the electrical contact module with the second outer housing member.

22. A method as in claim 20 wherein the step of overmolding the housing piece onto the at least one electrical contact comprises forming the housing piece as a general block shape with top and bottom ends of the electrical contact extending from top and bottom sides of the housing piece.

* * * * *